United States Patent [19]

O'Brien, Jr. et al.

[11] Patent Number: 4,643,236

[45] Date of Patent: Feb. 17, 1987

[54] FEED ROLL TENSIONING DEVICE

[75] Inventors: John A. O'Brien, Jr., Birmingham; James H. Hutson, Pell City, both of Ala.

[73] Assignee: Outboard Marine Corporation, Waukegan, Ill.

[21] Appl. No.: 805,718

[22] Filed: Dec. 6, 1985

[51] Int. Cl.[4] ..... B27L 5/02

[52] U.S. Cl. ..... 144/208 E; 144/340

[58] Field of Search ..... 144/208 R, 208 E, 340

[56] References Cited

U.S. PATENT DOCUMENTS

| | | | |
|---|---|---|---|
| 2,785,715 | 3/1957 | Brundell et al. | 144/208 E |
| 2,857,945 | 10/1958 | Brundell et al. | 144/208 E |
| 2,860,672 | 11/1958 | Brundell et al. | 144/208 E |
| 2,903,028 | 9/1959 | Baundell et al. | 144/208 E |
| 4,585,042 | 4/1986 | Hutson | 144/208 E |

*Primary Examiner*—W. D. Bray

*Attorney, Agent, or Firm*—Michael, Best & Friedrich

[57] ABSTRACT

A log debraking machine including a rotor having a central opening and a plurality of debarking tools, a rotating means for rotating said rotor about its longitudinal axis, and a feeding means including a plurality of log gripping rollers positioned for rolling contact with the logs and for feeding logs in the direction of the longitudinal axis. The log gripping rollers are supported for movement toward and away from the longitudinal axis of the rotor, and apparatus is provided for biasing the rollers toward the longitudinal axis of the rotor. The apparatus for biasing applies a reduced force on the rollers when the rollers are between a first closed position adjacent the longitudinal axis and a first outward position and an increased force on the rollers when the rollers are positioned between a first outward position and an open position.

12 Claims, 6 Drawing Figures

FEED ROLL TENSIONING DEVICE

FIELD OF THE INVENTION

The present invention relates to log debarking machines and more particularly to roller assemblies for use in feeding logs through log debarking machines.

BACKGROUND OF THE INVENTION

Ring type debarkers of the type commonly used in the lumber and paper industry to remove bark from logs, have included a triangular configuration of infeed and outfeed rollers to apply thrust to a log to force it longitudinally through a rotating ring debarking unit while holding the log to prevent rotation of the log while bark is being removed.

In the prior art apparatus, as a log enters the roller assembly, the rollers are held in a closed position by a preset, pretension force on the rollers, and during initial engagement of a leading end of a log against the rollers when the rollers are in their closed position, substantial force is required to cause the infeed rollers to climb the leading end of the log so that the rollers can then ride on the outside surface of the logs and apply a compressive force against the logs. During the stage of the operation wherein the leading end of a log first contacts the rollers, and as the rollers separate to permit the log to move between the rollers, and prior to positioning of the rollers on the exterior surface of the log, the tension force on the rollers serves no purpose other than as a deterrent to roll opening and movement of the log through the debarking machine. Additionally, as the rolls begin to climb the leading end of the log, the holddown force on the rollers increases as the rollers move outwardly. If the log engaging the rollers has a large cross sectional diameter, a substantial amount of power is required to cause the rollers to climb the leading end of the log. In some cases, the increase in holddown force caused by initial outward movement of the rollers, as the leading end of the log engages the rollers, may be so great that the rollers will not be permitted to move to the open, log engaging position. The operator must then manually cause the rollers to open by means of additional valving.

In the existing machines, a pneumatic cylinder is used to apply a preset holddown force on the rollers, and a certain pressure, typically 50 to 70 psi, is applied to the rod side of the pneumatic cylinder causing it to retract, and, in so doing, to cause the feed rollers to close. A pressure regulator is used to control this pressure in the pneumatic cylinder, and a check valve is typically used downstream of the pressure regulator. The check valve insures that backflow cannot occur. A relief valve is teed in the line between the check valve and the rod side of the cylinder. Typically this relief valve is set at 90 psi. On some installments the blank side or cap end of the cylinder is connected to another pressure regulator set at a pressure of 5 to 20 psi. This fluid line also has a check valve and a relief valve, the relief valve being set typically at 45 psi.

During normal operation of the prior art structures, when the rollers are in the extended or open position, the pressure regulator connected to the blank side of the pneumatic cylinder applies a 5 to 20 psi pressure to the blank side volume. When the logs passes through the rollers, the pressure in the rod side of the cylinder causes the rollers to close, and the closing of the rollers is opposed by the 5 to 20 psi pressure in the blank end of the cylinder. This pressure will increase until the relief valve setting of 45 psi is reached whereupon the relief valve will open and maintain a 45 psi back pressure. Should the relief valve be undersized or in some way become restricted, the pressure in the blank side of the pneumatic cylinder can climb to a higher level. This will cause a net reduction in the holddown force and a slowing down in the closing action of the rollers. As the log clears the infeed rollers, it is preferred that the rollers close rapidly in anticipation of the next log. Should the next log have a small diameter at its leading end relative to the diameter of the trailing end of the previous log, slow closing of the rollers may result in the second log contacting the debarking tools prior to engagement of the rollers with the log. When this occurs, the log can flail and/or move out of the tool circle, either of which causes premature tool breakage, link bracket breakage and bearing failure.

Attention is also directed to the Brundell et al. U.S. Pat. No. 2,903,028, issued Sept. 18, 1959: the Brundell et al. U.S. Pat. No. 2,785,715, issued Mar. 19, 1957; the Brundell et al. U.S. Pat. No. 2,857,945, issued Oct. 28, 1958 and the Brundell et al. U.S. Pat. No. 2,866,672, issued Nov. 28, 1958.

SUMMARY OF THE INVENTION

The present invention provides a log debarking machine having a feed roller construction providing a means for effecting a predetermined adjustable holddown force on the feed rollers of the debarking machine while reducing this force during a standby condition and during the initial engagement of the rollers with the leading end of the log. The apparatus of the invention also provides a feed roller tensioning device that provides substantially a constant or controlled holddown force on the rollers once the holddown force is applied, and this holddown force can remain essentially constant or controlled regardless of the size of the log introduced into the log debarking machine. During the initial contact of the leading end of the log with the rollers, the holddown force on the rollers will be minimal, and the holddown force is applied only after the rollers have started to climb the leading end of the log or have achieved some degree of an open position.

More specifically, the invention includes a log debarking machine having a frame, a rotor supported by the frame for rotation about a longitudinal axis of the rotor, the rotor including a central opening, a rotating means for rotating the rotor about the longitudinal axis of the rotor, and a plurality of debarking tools attached to the rotor for rotation about the longitudinal axis of the rotor. A feeding means is also provided for feeding logs in the direction of the longitudinal axis of the rotor through the central opening of the rotor, the feeding means including a plurality of log gripping rollers positioned for rolling contact with the logs, each of the log gripping rollers having an axis of rotation and means for causing rotation of the log gripping rollers about the axis of rotation. Means are also provided for supporting the log gripping rollers for movement toward and away from the longitudinal axis of the rotor. Further included are means for applying a force on the rollers to bias the rollers toward the longitudinal axis of the rotor, the means for applying force on the rollers including means for applying a reduced force on the rollers toward the longitudinal axis when the rollers are between a first closed position adjacent the longitudinal axis and a first outward position spaced from the longitudinal axis. Means are also provided for applying an increased force on the rollers when the rollers are positioned between the first outward position and an open position wherein the rollers are in a log mounted position.

In one embodiment of the invention the reduced force on the rollers is constant when the rollers are between the first position adjacent the longitudinal axis of the rotor and the first outward position, and the second force on the rollers is constant as the rollers are positioned between the first outward position and the open position.

In one embodiment of the invention the means for applying an increased force on the rollers includes means for increasing the force on the rollers toward the longitudinal axis as the rollers move from the first outward position toward the open position.

The invention further includes a log debarking machine including a frame, a rotor supported by the frame for rotation about a longitudinal axis of the rotor, the rotor including a central opening, a rotating means for rotating the rotor about the longitudinal axis, and a plurality of debarking tools attached to the rotor for rotation about the longitudinal axis of the rotor. Also included is a feeding means for feeding logs in the direction of the longitudinal axis of the rotor through the central opening of the rotor, the feeding means including a plurality of log gripping rollers positioned for rolling contact with the logs, means for supporting the log gripping rollers for movement toward and away from the longitudinal axis of the rotor, and means for applying a force on the log gripping rollers to bias the log gripping rollers toward the longitudinal axis of the rotor. The means for applying force on the rollers includes a cylinder having opposite ends, a first fluid conduit connected to one of the opposite ends of the cylinder and a second fluid conduit connected to the other of the opposite ends of the cylinder. The first fluid conduit includes a first means for supplying fluid pressure to the one of the opposite ends of the cylinder at a first fluid pressure, and first means for selectively venting the one end of the cylinder if fluid pressure in the one end of the cylinder is greater than the first fluid pressure. The second fluid conduit includes a second means for selectively providing a second fluid pressure from the second fluid conduit to the other end of the cylinder, a third means for selectively providing a third fluid pressure from the second fluid conduit to the other end of the cylinder, and second means for selectively venting the other end of the cylinder when the fluid pressure in the other end of the cylinder exceeds the fluid pressure provided to the other end of the cylinder through a selected one of the second means for selectively providing a second fluid pressure and the third means for selectively providing a third fluid pressure. Means are further provided for alternatively connecting one of the second means for selectively providing a second fluid pressure and the third means for selectively providing a third fluid pressure to the end of the cylinder.

In one embodiment of the invention the means for supplying fluid to the one end of the cylinder at a first fluid pressure includes a first pressure regulator.

In one embodiment of the invention the first means for selectively venting includes a first pressure relief valve between the first means for supplying fluid and the one end of the cylinder, means for sensing pressure between the first means for supplying and the first pressure relief valve, means for sensing pressure between the first pressure relief valve and the one end of the cylinder, and means for comparing the pressure sensed between the first means for supplying and the first pressure relief valve and the pressure sensed between the first pressure relief valve and the one end of the cylinder. The means for comparing includes means for venting the one end of the cylinder when the pressure sensed between the first pressure relief valve and the one end of the cylinder is greater than the pressure between the first means for supplying and the first pressure relief valve.

In one embodiment of the invention the second means for selectively providing a second fluid pressure includes a second pressure regulator and the third means for selectively providing a third fluid pressure includes a third pressure regulator.

In one embodiment of the invention the means for alternatively connecting includes means for alternatively connecting one of the second pressure regulator and the third pressure regulator to the second means for selectively venting the other of the opposite ends of the cylinder, the means for alternatively connecting including a valve means responsive to the position of the piston cylinder.

In one embodiment of the invention the means for alternatively connecting includes a cam supported by the piston for movement with the piston, and a switch selectively engaged by the cam when the piston is in a selected position. The valve means includes a solenoid operated valve operably connected to the switch, and the solenoid operated valve is operably connected to the second pressure regulator and to the third pressure regulator.

Various other features of the invention will be apparent by reference to the following description of a preferred embodiment, from the drawings and from the claims.

Figure 1:
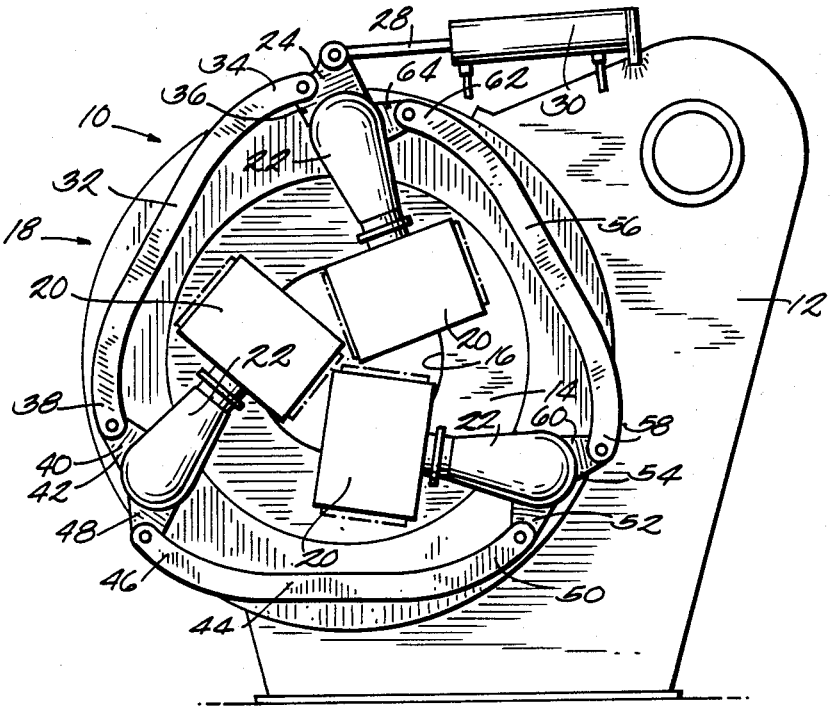
FIG. 1 is an end elevation view of a log debarking machine embodying the present invention.

Before describing at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology is for the purpose of description and should not be regarded as limiting.

DESCRIPTION OF A PREFERRED EMBODIMENT

Illustrated in FIG. 1 is a rotary debarking machine 10 including a frame 12 supporting a rotatably driven rotor 14. The rotor 14 is an annular structure including a central opening 16. Logs are fed through the central opening 16 of the annular rotor 14 and a plurality of debarking tools (not shown) carried by the rotor 14 engage the bark of the logs fed through the rotor 14 and remove bark from the logs as the rotor rotates around its longitudinal axis.

Means are also provided for feeding a log through the central opening 16 of the rotor 14, this means for feeding including a pair of feed roller assemblies 18 mounted on opposite sides of the rotor 14, one of the feed roller assemblies 18 being positioned on one side of the rotor 14 to feed logs into the rotor and a second one of the feed roller assemblies 18 (not shown) being positioned on the other side of the rotor 14 to pull the logs through the rotor. The feed roller assemblies 18 can have an identical construction and only one will be described in detail.

The illustrated feed roller assembly 18 includes a plurality of rollers 20 adapted to engage a log therebetween and being rotatably driven so as to move a log gripped by the rollers 20 in the direction of the longitudinal axis of the rotor 14. Means are also provided for supporting the rollers 20 for movement between an open position wherein the rollers are spaced apart and the illustrated closed position. In the illustrated arrangement the rollers are supported on pivotal arms 22, each of the arms 22 including opposite ends and one of the ends being pivotally joined to the frame 12 for pivotable movement about an axis parallel to the longitudinal axis of the rotor 14. Opposite ends of the arms 22 support the rollers 20. In the illustrated construction, the log debarking machine 10 includes three rollers 20, and the arms 22 supporting the rollers are spaced evenly circumferentially around the axis of rotation of the rotor.

Means are also provided for causing simultaneous movement of the rollers 20 toward and away from the axis of rotation of the rotor 14. This means includes a first bellcrank 24 fixed to a first arm 22 supporting one of the rollers, the first bellcrank 24 including a first lever 26 having a projecting end pivotally connected to the extensible piston 28 of the pneumatic cylinder 30. The bellcrank 24 connects the extensible piston to the arm 22 supporting the roller such that extension of the piston 28 causes movement of the roller 20 from a closed position to an open position.

Means are also provided for causing pivotal movement of the adjacent arms 22 in response to movement of the first arm 22, this means including a first connecting link 32 having one end 34 pivotally connected to a second lever arm 36 of the bellcrank 24 and an opposite end 38 pivotally connected to a first lever arm 40 of a second bellcrank 42, the second bellcrank 42 being fixed in turn to the arm 22 carrying the second roller 20. A second connecting link 44 has one end 46 pivotally connected to a second lever arm 48 of the second bellcrank 42 and an opposite end 50 pivotally connected to a first lever arm 52 of a third bellcrank 54 in turn fixed to the arm 22 carrying the third roller 20. A third connecting link 56 has one end 58 pivotally connected to a second lever arm 60 of the third bellcrank 54 and an opposite end 62 pivotally connected to a third lever arm 64 of the first bellcrank 24.

The connecting links 32, 44 and 56 and the bellcranks 24, 42 and 54 connect the pivot arms 22 such that when the pneumatic cylinder 30 causes movement of one of the rollers 20, the remainder of the rollers 20 move in unison with the first roller 20 toward or away from the longitudinal axis of the rotor.

Figure 2:
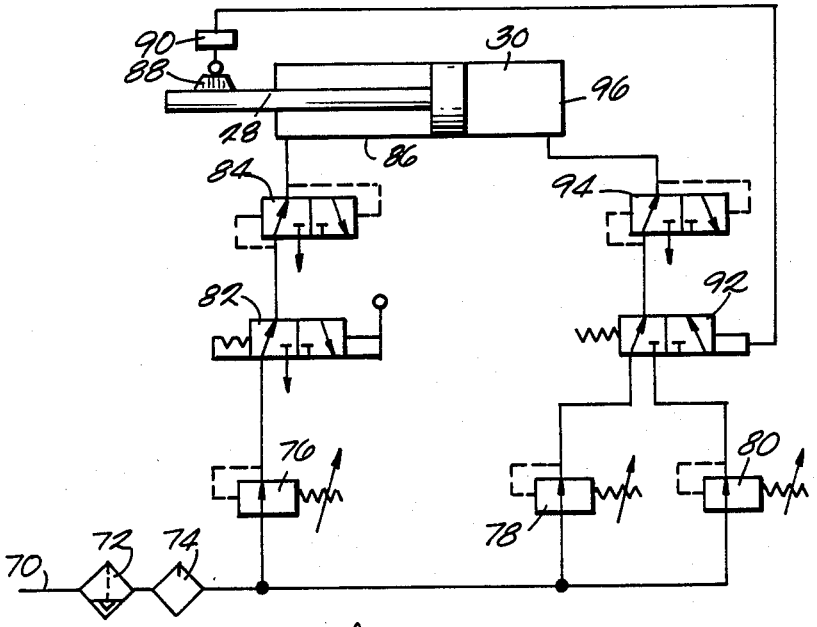
FIG. 2 is a schematic view of a pneumatic circuit for operating the pneumatic cylinder of the roller hold-down device illustrated in FIG. 1.

Means are also provided for selectively controlling the pneumatic pressure supplied to the cylinder 30 to thereby control the pretension force on the rollers 20 toward the axis of rotation of the rotor 14. FIG. 2 illustrates schematically one embodiment of the means for controlling the fluid pressure supplied to the cylinder 30. While in the embodiment of the invention described herein, the cylinder 30 is a pneumatic cylinder and the control means controls the supply of air to the pneumatic cylinder 30, in other arrangements the cylinder 30 could be a hydraulic cylinder, and the control means could supply hydraulic fluid to the hydraulic cylinder.

The means illustrated in FIG. 2 for selectively controlling the pneumatic pressure supplied to the cylinder 30 to thereby control the pretension force on the rollers 20 includes a means for affecting a predetermined holddown force on the feed rollers 20 of the debarking machine 10 while reducing the holddown force during the initial opening of the roller 20 to thereby permit relatively unobstructed movement of the rollers from the closed position to a first or intermediate position wherein the rollers 20 approach a position wherein they can engage the exterior of a log and then providing for relatively constant holddown force on the rollers 20 regardless of the amount of further outward movement of the rollers from the intermediate position.

Compressed air being supplied to the pneumatic cylinder 30 through air conduit 70 enters through an air filter 72 and air line lubricator 74 and is directed to pressure regulators 76, 78 and 80. Typically these pressure regulators 76, 78 and 80 are set at 55 psi, 40 psi, and 5 psi, respectively. These values can vary widely from machine to machine and are specified here only for purposes of example. Air passing through the pressure regulator 76 proceeds through a manual control valve 82, through a quick exhaust valve 84 and enters the rod side 86 of the cylinder 30 thereby causing the piston and rod 28 of the cylinder 30 to retract. Upon retraction of piston 28, a cam 88 carried by piston 28 comes in contact with a limit switch 90 thereby causing the limit switch 90 to actuate. Actuation of the limit switch 90 results in deenergization of a solenoid operated selector valve 92 to thereby cause the solenoid operated selector valve 92 to assume the position illustrated in FIG. 2.

Simultaneously, air passes through the pressure regulators 78 and 80 and flows to the solenoid operated selector valve 92. When the selector valve 92 is in the deenergized position shown, the flow from pressure regulator 80 is blocked while the flow from pressure regulator 78 passes through the solenoid operated selector valve 92, through a quick exhaust valve 94 and into the cap end or blank end 96 of the pneumatic cylinder 30. In this condition a 55 psi air pressure is applied to the rod side 86 of the pneumatic cylinder 30, and a 40 psi air pressure is applied to the blank side 96 of the pneumatic cylinder 30. The resultant force on the piston 28 in the direction of retraction is relatively low.

When the leading end of the log contacts the rollers 20, the rotation of the rollers 20 initiates a climbing action of the rollers 20 on the leading end of the log and thereby causes the rollers 20 to move outwardly with respect to the longitudinal axis of the rotor 14. Such movement of the rollers 20 causes the piston and rod 28 of the pneumatic cylinder 30 to be extended or pulled out with respect to the cylinder body. In the process of this extension, the air in the rod side 86 of the pneumatic cylinder 30 tends to be compressed. The quick exhaust valve 84 senses the downstream pressure in the rod end 86 of the pneumatic cylinder 30 and vents the rod end 86 of the pneumatic cylinder to atmosphere if the pressure in the rod end 86 of the cylinder 30 exceeds the upstream pressure supplied to the quick exhaust valve 84. As a result, the pressure in the rod end 86 of the cylinder 30 is always the same as the air pressure supplied through the pressure regulator 76. Pressure on the blank side 96 of the pneumatic cylinder 30 will be the pressure supplied through the pressure regulator 78 as long as the cam 88 stays in contact with the limit switch 90. In this condition a relatively low holddown force is generated on the rollers 20, and this relatively low holddown force is maintained during the initial opening of the rollers 20.

When, however, the cam 88 moves past the limit switch 90, the solenoid valve 92 is then energized thereby blocking airflow from the regulator 78 to the quick exhaust valve 94 and simultaneously directing airflow from the pressure regulator 80 to the quick exhaust valve 94. The quick exhaust valve 94 will then vent the blank side 96 of the pneumatic cylinder 30 to thereby reduce the pressure in the blank side 96 of the pneumatic cylinder 30 to that of the pressure supplied through the pressure regulator 80. In this condition, the pressure on the rod side 86 of the cylinder is 55 psi while the pressure on the blank side 96 of the pneumatic cylinder is 5 psi. As a result, the holddown force applied to the rollers 20 increases to a relatively high holddown force.

When the log then passes through the rollers 20, the pressure in the rod side 86 of the cylinder 30 will cause the piston and rod 28 to retract, and the air pressure in the blank side 96 of the pneumatic cylinder 30 will be vented through the quick exhaust valve 94 to atmosphere while maintaining a back pressure equivalent to the pressure setting of the pressure regulator 80. This back pressure in the blank side 96 of the pneumatic cylinder 30 is effective to provide cushioned retraction of the piston 28. As the piston 28 moves to a position wherein the rollers 20 approach their closed position, the cam 88 will again contact the limit switch 90 to thereby cause the solenoid valve 92 to be deenergized thereby blocking the supply of air pressure from the pressure regulator 80 and directing airflow from the pressure regulator 78 to the blank side 96 of the cylinder 30. This once again increases the air pressure in the blank side 96 of the cylinder and reduces the holddown force provided by the piston 28 to a minimum level.

It will be readily appreciated by those skilled in the art that the length of the cam 88 determines the amount of movement of the rollers 20 from the closed position before the application of a full holddown force by the pneumatic cylinder 30. It will also be appreciated that the interaction of the combination of the quick exhaust valves 84 and 94 in further combination with the pressure regulators 76, 78 and 80 insures a constant holddown force by the cylinder 30 on the rollers in both the working and standby modes.

Figure 3:
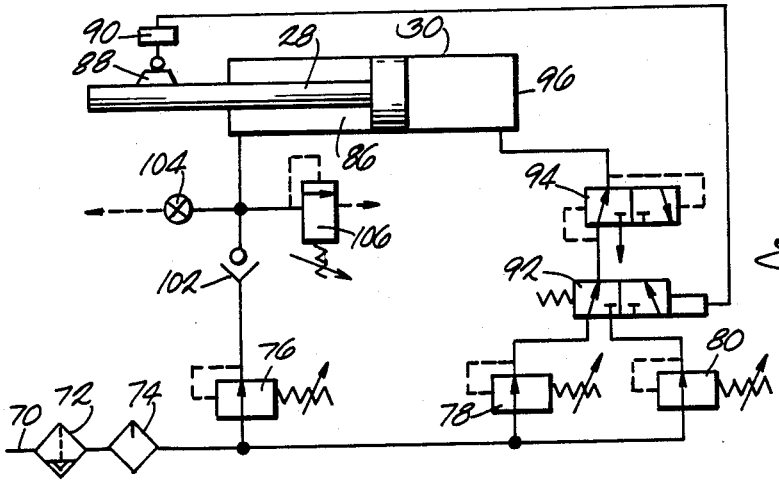
FIG. 3 is a view similar to FIG. 2 and showing an alternative embodiment of a pneumatic circuit.

FIG. 3 illustrates another embodiment of the pneumatic apparatus illustrated in FIG. 2 and provides a means, following the initial outward movement of the rollers 20, for increasing the holddown force on the rollers as the log diameter increases, yet providing for relatively easy initial opening of the rollers 20 during engagement of the leading end of the log with the rollers, and further providing for rapid movement of the rollers 20 to the closed position once the log has passed through the rollers 20. With the configuration illustrated in FIG. 3, as in the FIG. 2 arrangement, air is introduced through an airline filter 72 and an airline lubricator 74 to pressure regulators 76, 78 and 80. As in the structure illustrated in FIG. 2, the typical settings of these pressure regulators are 55 psi, 40 psi and 5 psi, respectively. As also set forth above, these values are identified merely for purposes of example and not by way of limitation.

Air passing through the pressure regulator 76 flows through a check valve 102 which functions to prevent any reverse flow. The air is then directed to the rod side 86 of the pneumatic cylinder 30 to thereby cause the piston and rod 28 to retract. A manual valve 104 remains closed and is intended to provide a means for venting the rod side of the pneumatic cylinder after the other valves have been actuated, to remove pressure from the system. A pressure relief valve 106 is also provided to limit the maximum pressure allowed in the rod side 86 of the cylinder 30. The pressure regulators 78 and 80 and solenoid operated selector valve 92 as well as a quick exahust valve 94 work in combination with a limit switch 90 and cam 88 in the manner as described in connection with FIG. 2.

In operation of the apparatus illustrated in FIG. 3, the piston and rod 28 are retracted and held in position by air pressure determined by the setting of a pressure regulator 76. The force in the rod side 86 of the cylinder 30 is opposed by air pressure applied to the blank side 96 of the cylinder, this air pressure being controlled by the setting of the pressure regulator 78 when the rollers 20 are in their closed or standby position. The holddown force in this condition provided by the piston 28 is minimal.

As the rollers 20 are contacted by the leading end of a log and begin to move outwardly from their closed position, the cam 88 moves away from the limit switch 90 and the limit switch 90 causes the solenoid actuated valve 92 to interrupt the supply of air pressure from the pressure regulator 78 to the quick exhaust valve 94 and to supply air pressure from the pressure regulator 80 to the quick exhaust valve 94. The quick exhaust valve 94 functions to vent the blank side 96 of the pneumatic cylinder 32 such that the air pressure in the blank side of the pneumatic cylinder will be equal to the air pressure supplied from the pressure regulator 80. This low pressure in the blank side 96 of the pneumatic cylinder will remain constant regardless of the position of the piston and rod 28 until such time as the cam 88 again engages the limit switch 90. As the piston 28 is drawn out of the cylinder 30 by the action of the rollers 20 being opened, the pressure in the rod side 86 of the cylinder 30 is, on the other hand, intensified. This intensification of the pressure in the rod side 86 of the pneumatic cylinder increases until the rollers have reached their maximum opened position or until the setting of the relief valve 106 is achieved. If the relief valve 106 opens, any further opening of the rollers 20 will not generate an increased fluid pressure in the rod side 86 of the pneumatic cylinder nor any consequent increase in the holddown force.

After the log has passed through the rollers 20, the pneumatic pressure in the rod side 86 of the pneumatic cylinder will cause retraction of the piston 28 and closing of the rollers. The air pressure in the blank side 96 of the pneumatic cylinder is relatively low and will permit relatively rapid movement of the piston 28 until the cam 88 once again engages the limit switch 90. When the cam 88 engages limit switch 90, the solenoid valve 92 is deenergized thereby interrupting the supply of air from the pressure regulator 80 to the valve 94 and supplying air pressure from the regulator 78 to the blank side 96 of the pneumatic cylinder.

In the embodiment illustrated in FIG. 3, pressure intensification caused by movement of the piston 28 in the pneumatic cylinder functions to increase the holddown force of the rollers 20 as the rollers move from their open position, and a low constant counterbalance pressure is maintained in the blank side 96 of the pneumatic cylinder.

Figure 4:
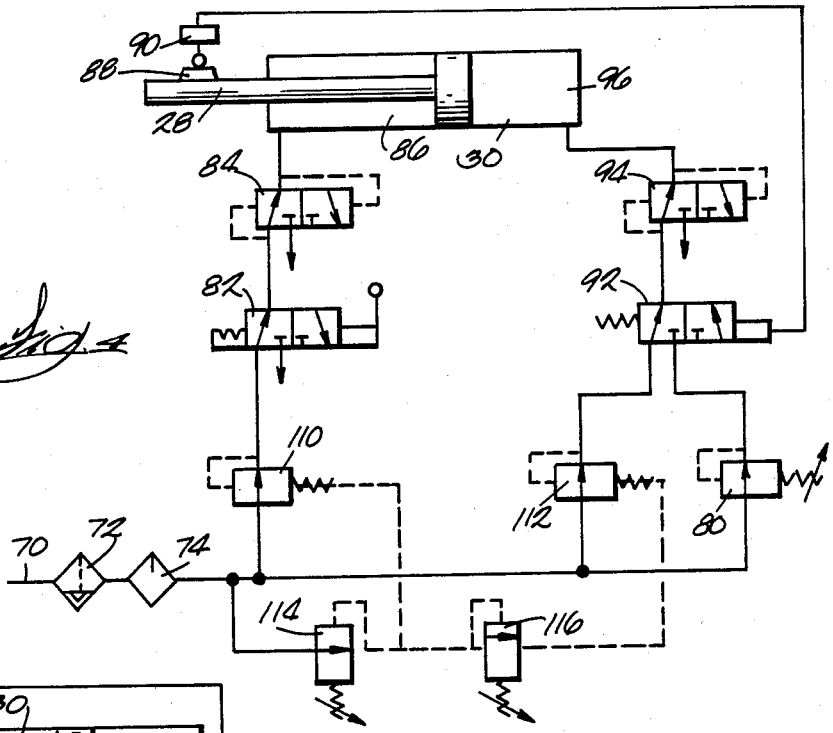
FIG. 4 is a view similar to FIGS. 2 and 3 and showing another alternative embodiment.

FIG. 4 illustrates another alternative embodiment of the pneumatic circuits illustrated in FIGS. 2 and 3 and provides a means whereby the small initial, or standby, holddown force on the rollers 20 can be maintained or held constant while the operating holddown force may be adjusted as required. In the arrangement illustrated in FIG. 4, air from air line 70 enters through an air line filter 72 and air line lubricator 74 and proceeds to pressure regulators 110, 112 and 80. The pressure regulators 110 and 112 are similar to regulators 76 and 78 identified in FIGS. 2 and 3 except that the pressure regulators 110 and 112 comprise remote pilot operated valves and their pressure settings are determined by the settings of pilot regulator 114 and relief or resistance valve 116. As the setting of the pilot regulator 114 is increased, the settings of regulators 110 and 112 are also increased. The apparatus illustrated in FIG. 4 further includes a pressure relief valve 116, the pressure relief valve 116 being an adjustable valve whereby a specific amount of pressure can be removed from the pilot signal supplied to the control section of the pressure regulator 112. If the pressure relief valve 116 is set at 20 psi, the pressure regulator 112 will have a setting of 20 psi below that of the regulator 110.

In operation of the apparatus illustrated in FIG. 4, the pressure relief valve 116 functions as a conventional bias valve and determines the effective holddown force on the rollers 20 when the rollers 20 are in their closed or standby position. An upward or downward adjustment of the pressure supplied by the pilot regulator 114 will determine the operating holddown force of the rollers 20 during their log engaging operation, but will have no effect on the pressure provided when the rollers 20 are in the closed position.

Figure 5:
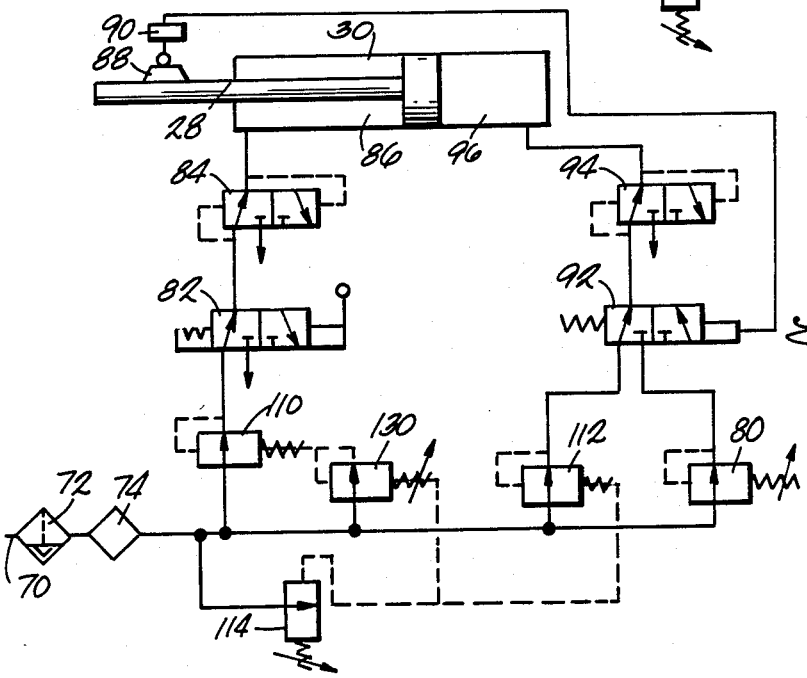
FIG. 5 is a view similar to FIGS. 2–4 and showing another alternative embodiment.

FIG. 5 illustrates a further alternative embodiment of the pneumatic control circuits illustrated in FIGS. 2–4 and illustrates a similar arrangement to that in FIG. 4 but utilizing pressure regulators 110 and 112 controlled by a remote pilot regulator 114 and further including a pilot operated regulator 130 provided to control operation of the pilot regulator 114.

In the embodiment shown in FIG. 5, the pressure regulators 110 and 112 are still remote controlled by a pilot regulator 114, but instead of having a pressure relief valve 116 inserted in the pilot circuit, a pilot operated pressure regulator 130 is operably connected between the pilot regulator 114 and the pressure regulator 110. The pilot operated pressure regulator 130 includes a bias spring such that output of the pilot operated pressure regulator is increased by the force of the bias spring. The bias spring may have a force equivalent to 20 psi and accordingly the pilot signal from pilot operated pressure regulator 130 to the pressure regulator 110 will be 20 psi higher than the pilot end of pressure regulator 112. Adjustment of the pilot operated pressure regulator and thus control the difference in pressure supplied through the pressure regulators 110 and 112.

Figure 6:
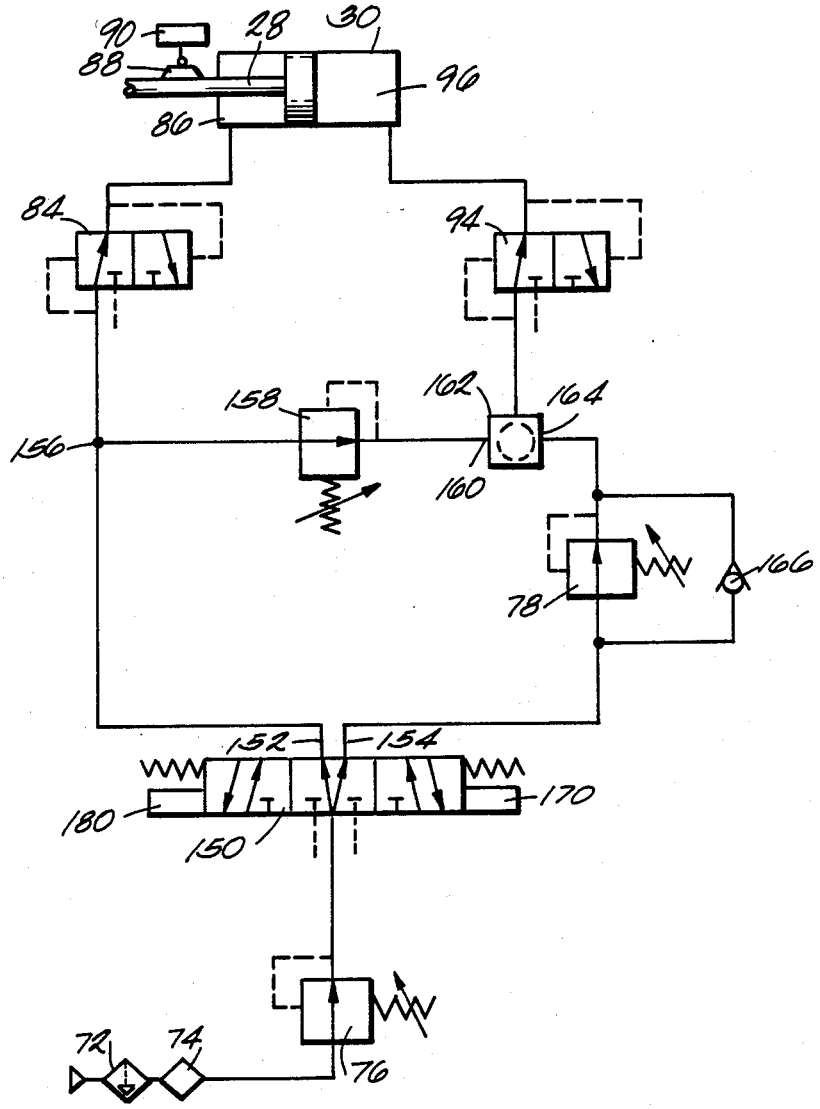
FIG. 6 is a view similar to FIG. 2 and showing another alternative embodiment of the invention.

FIG. 6 illustrates a further embodiment of the apparatus shown in FIG. 2 and comprises a simplified version of the pneumatic system shown there. In the system shown in FIG. 6, air is introduced into the system via an airline filter 72, an airline lubricator 74 and through a pressure regulator 76. As in the embodiments described above, the pressure regulator 76 can typically be set at 55 psi. The air from the pressure regulator 76 is conveyed to the inlet port of a directional valve 150 which, in the neutral condition illustrated in FIG. 6, allows passage of air to outlet ports 152 and 154 simultaneously.

The air passing through the outlet port 152 is directed through a quick exhaust valve 84 and into the rod end 86 of the cylinder 30. A "tee" 156 is provided between the directional valve 150 and the quick exhaust valve 84 and provides for air to be directed through a pressure regulator 158 to an inlet port 160 of a shuttle valve 162. In one embodiment of the invention, the pressure regulator 158 can typically be set at 5 psi.

The air passing through the outlet port 154 of the directional valve 150 is directed through a pressure regulator 78 to the other inlet port 164 of the shuttle valve 162. Typically, the pressure regulator 78 can be set at 40 psi. It should be understood that the pressures referred to above are stated merely for purposes of example and could be varied. A check valve 166 is provided in parallel with the pressure regulator 78, the check valve 166 preventing air from bypassing the pressure regulator 78 as it flows from the directional valve 150 to the shuttle valve 162.

The shuttle valve 162 will thus have 5 psi at one inlet port 160 and 40 psi at the other inlet port 164. As a result of the differences in pressure at the inlet ports 160 and 164 of the shuttle valve 162, the shuttle will move to that side of the shuttle valve 162 permitting the higher of the two pressures, i.e., 40 psi to pass on through a quick exhaust valve 94 and into the blank or cap end 96 of the cylinder 30.

Thus, with the directional valve 150 in the neutral position, 55 psi is applied to the rod side 86 of the cylinder 30 and 40 psi air pressure is applied to the cap end or blank side 96 of the cylinder 30. This results in a relatively low net force on the piston 28 attempting to hold the piston 28 in the retracted position, the retracted position corresponding to the closed position of the feed rolls. It will be readily appreciated that the closer the values of the two air pressures applied to the ends of the cylinder 30, the lower will be the value of the holddown of the force on the piston 28.

When an incoming log engages the rolls 20 and thereby causes them to begin to open, the piston 28 of the cylinder 30 will be extended. As the piston 28 moves, the limit switch 90 will lose contact with the cam 88 on the piston 28, and in doing so, the limit switch 90 will be activated which in turn energizes the solenoid 170 of the valve 150. When the solenoid 170 is energized, the valve 150 is shifted to thereby cause air to flow to the outlet port 152 and ultimately to the rod end 86 of the cylinder 30 and through the regulator 158 to the inlet 160 of the shuttle valve 162. Simultaneously, the outlet port 154 is connected to atmosphere thus venting the air from the high pressure side 164 of the shuttle valve 162 through the check valve 166. Due to this venting process, low air pressure from the regulator 158 is directed through the shuttle valve 162, through to the quick exhause valve 94, and into the cap end 96 of the cylinder 30. In this mode, the pressure in the rod end 86 of the cylinder 30 is substantially greater than the pressure in the blank end 96 of the cylinder 30 and a maximum holddown force is experienced in the cylinder. As long as the limit switch 90 is not in contact with the cam 88, this pressure differential will exist regardless of the movement of the rolls 20 and movement of the piston 28.

When the log exits the machine, the rolls 20 will close, causing the piston 28 to retract. When the limit switch 90 comes in contact with the cam 88, the solenoid 170 will be de-energized thereby reintroducing higher pressure air through the pressure regulator 78 into the cap end 96 of the cylinder 30. This introduction of higher pressure into the cap end 96 of the cylinder 30 will cushion the piston 28 as the piston moves to its retracted position and will reduce the amount of closing force on the piston 28.

In the event that it is desired to open the rolls 20 completely for servicing, solenoid 180 can be energized while the action of limit switch 90 is overridden. This will cause air to be directed through the regulator 78 into the cap end 96 of the cylinder 30 while venting the air in the rod end 86 to the atmosphere. This results in extension of the piston 28 of the cylinder 30 to its extreme position to provide for movement of the rolls 20 to the wide open position.

Various features of the invention are set forth in the following claims.

We claim:

1. A log debarking machine comprising: a frame, a rotor having a central opening and supported by said frame for rotation about a longitudinal axis, and a feeding means for feeding logs in the direction of said longitudinal axis through said central opening of said rotor, said feeding means including a plurality of log gripping rollers positioned for rolling contact with the logs, means for supporting said log gripping rollers for movement toward and away from said longitudinal axis of said rotor, and means for applying a force on said rollers to bias said rollers toward said longitudinal axis, said means for applying force on said rollers including means for applying a reduced force on the rollers toward said longitudinal axis when the rollers are between a closed position adjacent said longitudinal axis and a first outward position spaced from said longitudinal axis, and means for applying an increased force on said rollers when said rollers are positioned between said first outward position and an open position.

2. A log debarking machine as set forth in claim 1 and wherein said reduced force on said rollers is constant when said rollers are between said first position adjacent said longitudinal axis of said rotor and said first outward position, and wherein said second force on said rollers is constant as said rollers are positioned between said first outward position and said open position.

3. A log debarking machine as set forth in claim 1 wherein said means for applying an increased force on said rollers includes means for increasing the force on said rollers toward said longitudinal axis as said rollers move from said first outward position toward said open position.

4. A log debarking machine comprising: a frame, a rotor supported by said frame for rotation about a longitudinal axis, said rotor including a central opening, and a feeding means for feeding logs in the direction of said longitudinal axis of said rotor through said central opening of said rotor, said feeding means including a plurality of log gripping rollers positioned for rolling contact with the logs, means for supporting said log gripping rollers for movement toward and away from said longitudinal axis of said rotor, and means for applying a force on said log gripping rollers to bias said log gripping rollers toward said longitudinal axis, said means for applying force on said rollers including a cylinder having opposite ends, a first fluid conduit connected to one of said opposite ends of said cylinder and a second fluid conduit connected to the other of said opposite ends of said cylinder, said first fluid conduit including first means for supplying fluid pressure to said one of said opposite ends of said cylinder at a first fluid pressure, and first means for selectively venting said one of said opposite ends of said cylinder if fluid pressure in said one of said ends of said cylinder is greater than said first fluid pressure, said second fluid conduit including second means for selectively providing a second fluid pressure from said second fluid conduit to said other of said opposite ends of said cylinder, and third means for selectively providing a third fluid pressure from said second fluid conduit to said other of said opposite ends of said cylinder, second means for selectively venting the other of said opposite ends of said cylinder when the fluid pressure in said other of said ends of said cylinder exceeds the fluid pressure provided to said other of said ends of said cylinder through a selected one of said second means for selectively providing a second fluid pressure and said third means for selectively providing a third fluid pressure, and means for alternatively connecting one of said second means for selectively providing a second fluid pressure and said third means for selectively providing a third fluid pressure to said other of said opposite ends of said cylinder.

5. A log debarking machine as set forth in claim 4 wherein said means for supplying fluid to said one of said opposite ends of said cylinder at a first fluid pressure includes a first pressure regulator.

6. A log debarking machine as set forth in claim 4 wherein said first means for selectively venting includes a first pressure relief valve between said first means for supplying fluid and said one of said ends of said cylinder, means for sensing pressure between said first means for supplying and said first pressure relief valve, means for sensing pressure between said first pressure relief valve and said one of said ends of said cylinder, and means for comparing the pressure sensed between said first means for supplying and said first pressure relief valve and the pressure sensed between said first pressure relief valve and said one of said ends of said cylinder, said means for comparing including means for venting said one end of said cylinder when the pressure sensed between said first pressure relief valve and said one of said ends of said cylinder is greater than the pressure between said first means for supplying and said first pressure relief valve.

7. A log debarking machine as set forth in claim 4 wherein said second means for selectively providing a second fluid pressure includes a second pressure regulator and wherein said third means for selectively providing a third fluid pressure includes a third pressure regulator.

8. A log debarking machine as set forth in claim 7 wherein said cylinder includes a reciprocating piston operably connected to said rollers, and wherein said means for alternatively connecting includes means for alternatively connecting one of the second pressure regulator and the third pressure regulator to said second means for selectively venting the other of said opposite ends of said cylinder, said means for alternatively connecting including a valve means responsive to the position of said piston.

9. A log debarking machine as set forth in claim 8 wherein said means for alternatively connecting includes a cam supported by said piston for movement with said piston, and a switch selectively engaged by said cam when said piston is in a selected position, and wherein said valve means includes a solenoid operated valve operably connected to said switch, said solenoid operated valve being operably connected to said second pressure regulator and to said third pressure regulator.

10. A log debarking machine comprising a frame, a rotor having a longitudinal axis and supported by said frame for rotation about said longitudinal axis of said rotor, said rotor including a central opening, rotating means for rotating said rotor about said longitudinal axis, a plurality of debarking tools attached to said rotor for rotation about said longitudinal axis of said rotor, feeding means for feeding logs in the direction of said longitudinal axis of said rotor through said central opening of said rotor, said feeding means including a plurality of log gripping rollers positioned for rolling contact with the logs, each of said log gripping rollers having an axis of rotation, and means for causing rotation of each of said log gripping rollers about its axis of rotation, means for supporting said log gripping rollers for movement toward and away from said longitudinal axis of said rotor, and means for applying force on said log gripping rollers for movement thereof toward said longitudinal axis, said means for applying force including a fluid cylinder having opposite ends, a first fluid conduit connected to one of said ends of said fluid cylinder and a second fluid conduit connected to the other of said ends of said cylinder, said first fluid conduit including a first pressure regulator for supplying fluid to said one of said ends of said cylinder at a first fluid pressure, and first means for selectively venting said one of said ends of said cylinder if fluid pressure in said one of said ends of said cylinder is greater than said first fluid pressure, said first means for selectively venting including a first pressure relief valve between said first pressure regulator and said one of said ends of said cylinder, and said means for selectively venting including means for sensing pressure between said first pressure regulator and said first pressure relief valve, means for sensing pressure between said first pressure relief valve and said one of said ends of said cylinder, and means for comparing the pressure sensed by said means for sensing pressure between said first pressure regulator said first pressure relief valve and by said means for sensing pressure between said first pressure relief valve and said one of said ends of said cylinder and for venting said one end of said cylinder if the pressure sensed between said first pressure regulator and said first pressure relief valve is greater than the pressure between said first pressure relief valve and said one end of said cylinder, a second fluid conduit including a second pressure regulator for selectively providing a second fluid pressure from said second fluid conduit to said other end of said cylinder, a third pressure regulator for selectively providing a third fluid pressure from said second fluid conduit to said other end of said cylinder, second means for selectively venting said other end of said cylinder when the fluid pressure in said other end of said cylinder exceeds the fluid pressure provided to said other end of said cylinder from a selected one of said second pressure regulator and said third pressure regulator, and means for selectively connecting one of said second pressure regulator and said third pressure regulator to said other end of said cylinder.

11. A log debarking machine as set forth in claim 10 wherein said cylinder includes a reciprocating piston operably connected to said rollers, and wherein said means for alternatively connecting includes means for alternatively connecting one of the second pressure regulator and the third pressure regulator to said second means for selectively venting said other of said ends of said cylinder, said means for alternatively connecting including a valve means responsive to the position of the piston.

12. A log debarking machine as set forth in claim 11 wherein said means for alternatively connecting includes a cam supported by said piston for movement with said piston, and a switch selectively engaged by said cam when said piston is in a selected position, and wherein said valve means includes a solenoid operated valve operably connected to said switch, said solenoid operated valve being operably connected to said second pressure regulator and to said third pressure regulator.

* * * * *